US012716406B1

(12) United States Patent
Chang

(10) Patent No.: US 12,716,406 B1
(45) Date of Patent: Aug. 25, 2026

(54) ROTARY MULTI-CYLINDER GAS COMPRESSOR

(71) Applicants: Shih-Ho Chang, Changhua City (TW); Han-Chih Chang, Changhua City (TW); Hsin-Yu Chang, Changhua City (TW)

(72) Inventor: Shih-Ho Chang, Changhua City (TW)

(73) Assignees: Shih-Ho Chang, Changhua City (TW); Han-Chih Chang, Changhua City (TW); Hsin-Yu Chang, Changhua City (TW)

( * ) Notice: Subject to any disclaimer, the term of this patent is extended or adjusted under 35 U.S.C. 154(b) by 0 days.

(21) Appl. No.: 19/290,956

(22) Filed: Aug. 5, 2025

(51) Int. Cl.
*F04B 27/06* (2006.01)
*F04B 27/04* (2006.01)

(52) U.S. Cl.
CPC ..... *F04B 27/0414* (2013.01); *F04B 27/0451* (2013.01); *F04B 27/06* (2013.01)

(58) Field of Classification Search
CPC .. F04B 27/04; F04B 27/0404; F04B 27/0414; F04B 27/0418; F04B 27/0451; F04B 27/06
USPC ..... 417/460–462
See application file for complete search history.

(56) References Cited

U.S. PATENT DOCUMENTS 830,636 A * 9/1906 Bergh ..... F04B 1/0426 91/496
944,913 A * 12/1909 Rogers ..... F04B 1/053 91/496
996,543 A * 6/1911 Hancox ..... F04B 1/053 417/457
2,389,709 A * 11/1945 Anders ..... F01B 1/0668 91/496
3,568,645 A * 3/1971 Grimm ..... F01C 1/3446 418/264
4,057,367 A * 11/1977 Moe ..... F04B 39/0016 417/273
5,636,599 A * 6/1997 Russell ..... F02B 57/10 123/54.1
5,701,930 A * 12/1997 Russell ..... F01L 1/04 123/189

(Continued)

FOREIGN PATENT DOCUMENTS

BR PI0520762 A2 * 5/2009 ..... F01B 9/06
CA 2747046 A1 * 1/2012 ..... F04B 27/0472

(Continued)

*Primary Examiner* — Thomas Fink
(74) *Attorney, Agent, or Firm* — MUNCY, GEISSLER, OLDS & LOWE, P.C.

(57) ABSTRACT

A rotary multi-cylinder gas compressor includes: a stator mechanism including stators including guide ring grooves forming a track; a rotor including a rotary body and a mandrel, the rotary body including cylinders and air holes corresponding to the cylinders; pistons received in the cylinders, each piston defining a piston top dead center and a piston bottom dead center sequentially located relative to the track; and an air cover mechanism connected to the stator mechanism and including air collecting elements and air intake channels, each air collecting elements forming an air collecting chamber between itself and the outer circumferential surface of the rotary body, each air collecting element including an air outlet conduit in communication with the air collecting chamber.

10 Claims, 17 Drawing Sheets

(56) References Cited

U.S. PATENT DOCUMENTS

| | | | | |
|---|---|---|---|---|
| 6,230,670 | B1 * | 5/2001 | Russell | F02B 63/04 123/44 E |
| 7,984,702 | B2 * | 7/2011 | Russell | F02P 13/00 123/162 |
| 8,113,165 | B2 * | 2/2012 | Russell | F01B 1/0603 123/56.7 |
| 8,225,753 | B2 * | 7/2012 | Sorrels | F01B 9/06 123/44 C |
| 10,527,007 | B2 * | 1/2020 | Russell | F01B 1/0624 |
| 2009/0194071 | A1 * | 8/2009 | Sorrels | F01B 9/06 123/45 R |
| 2021/0180576 | A1 * | 6/2021 | Zhu | F04B 1/0452 |

FOREIGN PATENT DOCUMENTS

| | | | | |
|---|---|---|---|---|
| GB | 190810263 | A * | 10/1908 | F04B 1/1133 |
| GB | 667830 | A * | 3/1952 | F04B 27/06 |
| KR | 100600581 | B1 * | 7/2006 | F01B 9/06 |
| KR | 20190101761 | A * | 9/2019 | F01B 1/0651 |

* cited by examiner

ROTARY MULTI-CYLINDER GAS COMPRESSOR

BACKGROUND OF THE INVENTION

Field of the Invention

The present invention relates to a gas compressor, particularly to a rotary multi-cylinder gas compressor.

Description of the Prior Art

The gas compressor is a common piece of equipment in industry, often used to compress gas into an air storage tank for cleaning or filling purposes or to power tools. However, the structure of conventional gas compressors is similar to that of internal combustion engines, namely, piston-type compressors. The reciprocating motion of the piston reduces work efficiency, and mechanical components such as the connecting rod and crankshaft that move in linkage with the piston rub against each other, not only reducing thermal efficiency but also generating high temperatures and noise.

Furthermore, the gas filling of conventional compressors cannot be effectively increased. Using a plurality of cylinders to improve speed would result in extremely large and impractical compressors in terms of volume and weight.

In addition, traditional gas compressors use crankshafts, making it impossible to connect a plurality of individual compressors on a single shaft in a series configuration. This spatial limitation prevents increasing the number of compressors, thus conventional compressors cannot produce large volumes of high-pressure gas in a short time, limiting their applications.

The present invention is, therefore, arisen to obviate or at least mitigate the above-mentioned disadvantages.

SUMMARY OF THE INVENTION

The main object of the present invention is to provide a gas compressor which is small in size, lightweight, low in production cost, and free from mutual friction between mechanical components, so that the compressor operates at high speed and significantly improves work efficiency.

To achieve the above and other objects, a rotary multi-cylinder gas compressor is provided, wherein the rotary multi-cylinder gas compressor includes: a stator mechanism including two stators, each of the two stators including a guide ring groove, the guide ring grooves of the two stators axially corresponding to each other to form a track; a rotor including a rotary body and a mandrel axially connected to the rotary body, the mandrel being rotatably and axially inserted in the two stators, the rotary body and the mandrel being synchronously rotatably disposed between the two stators, the rotary body including a plurality of cylinders and a plurality of air holes corresponding to the plurality of cylinders, two slots being oppositely disposed through a wall of each of the plurality of cylinders, the plurality of air holes being open on an outer circumferential surface of the rotary body and respectively in communication with interiors of the plurality of cylinders; a plurality of pistons respectively received in the plurality of cylinders, each of the plurality of pistons including a piston shaft axially extending through the two slots and movable along the track, each of the plurality of pistons defining a piston top dead center and a piston bottom dead center sequentially located relative to the track; and an air cover mechanism connected to the stator mechanism and including a plurality of air collecting elements and a plurality of air intake channels, the plurality of air collecting elements and the plurality of air intake channels being alternately arranged around the outer circumferential surface of the rotary body, each of the plurality of air collecting elements forming an air collecting chamber between itself and the outer circumferential surface of the rotary body, each of the plurality of air collecting elements including an air outlet conduit in communication with the air collecting chamber; wherein when all of the plurality of air holes in communication with one of the plurality of cylinders correspond to inner end surfaces between two sides of a bottom of one of the plurality of air collecting elements, the plurality of air holes of the one of the plurality of cylinders are blocked and not in communication with the plurality of air collecting elements and the plurality of air intake channels; wherein during an intake stroke in which the piston shaft of each of the plurality of pistons moves along the track from the piston top dead center to the piston bottom dead center in an intake stroke corresponding to the plurality of air intake channels, such that all or part of the plurality of air holes are in communication with one of the air intake channels to draw external gas into one of the plurality of cylinders; wherein during a compression stroke, which corresponds to the plurality of air collecting elements, in which each of the plurality of pistons moves from the piston bottom dead center to the piston top dead center, all or part of the plurality of air holes are in communication with one of the plurality of air collecting chambers to press the gas into one of the plurality of air collecting chambers.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
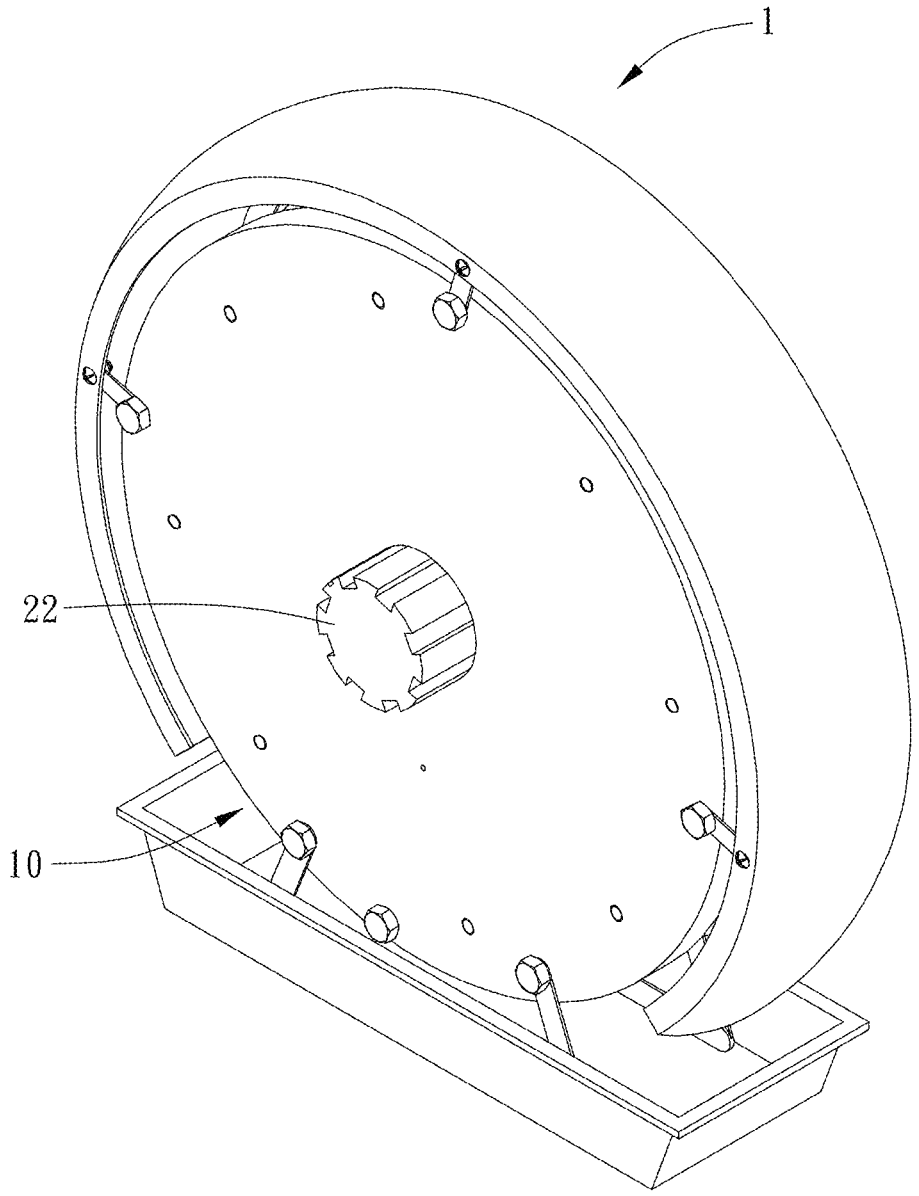
FIG. 1 is a perspective view of a first exemplary embodiment of the present invention.
Figure 2:
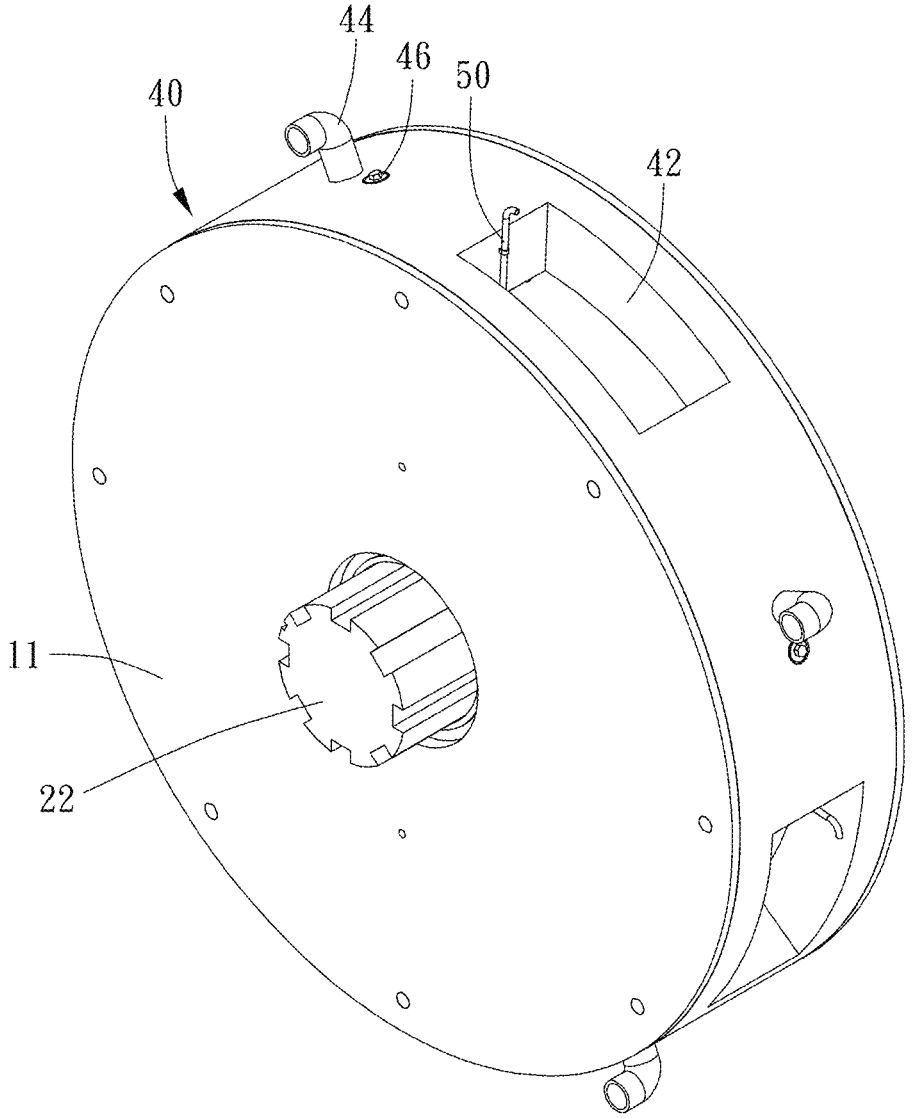
FIG. 2 is a partial perspective view of the first exemplary embodiment.

Please refer to FIGS. 1 to 7 for an exemplary embodiment of the present invention. A rotary multi-cylinder gas compressor 1 of the present invention includes a stator mechanism 10, a rotor 20, a plurality of pistons 30, and an air cover mechanism 40.

The stator mechanism 10 includes two stators 11 each including a guide ring groove 12. The guide ring grooves 12 axially correspond to each other to form a track 13. The rotor 20 includes a rotary body 21 and a mandrel 22 axially connected to the rotary body 21. The mandrel 22 is rotatably and axially inserted in the two stators 11, and the rotary body 21 and the mandrel 22 are synchronously rotatably disposed between the two stators 11. The rotary body 21 includes a plurality of cylinders 211 and a plurality of air holes 212 corresponding to the cylinders 211. Two slots 213 are disposed oppositely through the wall of each of the cylinders 211. The air holes 212 are open on the outer circumferential surface of the rotary body 21 and communicate with the interiors of the cylinders 211.

Figure 16:
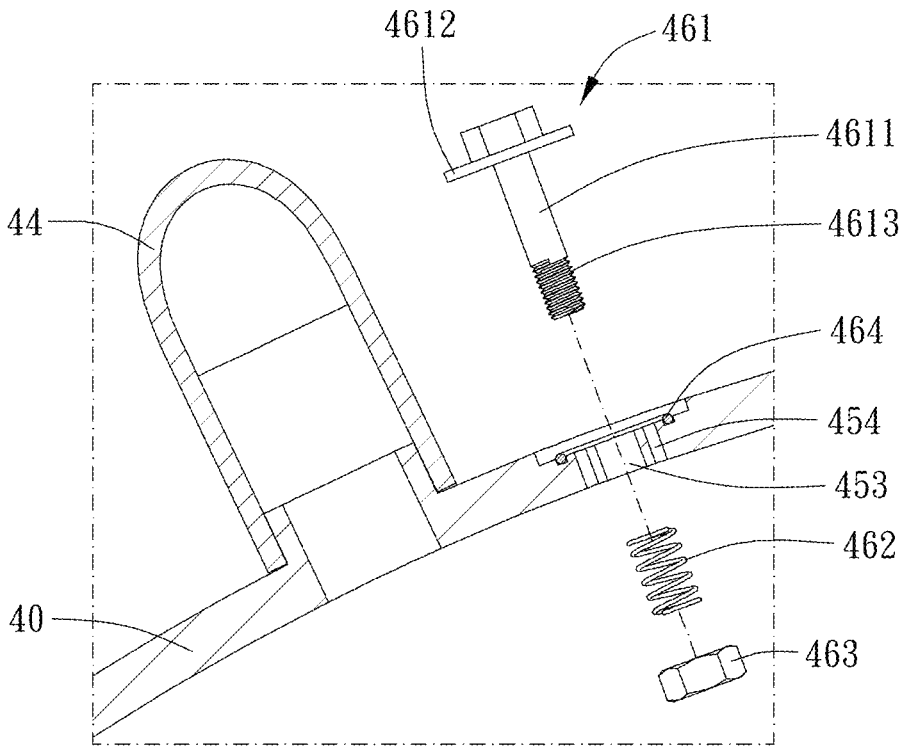
FIG. 16 is a partial cross-sectional view of the fourth exemplary embodiment.

The pistons 30 are received in the cylinders 211 and include piston shafts 31 axially protruding through the slots 213, respectively. The piston shafts 31 move along the track 13. Ends of each piston shaft 31 are inserted in the track 13 of the stator 11. As the rotary body 21 rotates, the ends of the piston shaft 31 move along the track, driving the pistons 30 to move up and down within the cylinders 211. Each piston 30 defines a piston top dead center P1 and a piston bottom dead center P2 respectively corresponding to a track top dead center 131 and a track bottom dead center 132. An end of each piston 30 is sleeved with an oil seal 32. The air cover mechanism 40 is connected to the stator mechanism 10 and includes a plurality of air collecting elements 41 and a plurality of air intake channels 42 communicating with the outside. The air collecting elements 41 and air intake channels 42 are alternately arranged around the outer circumferential surface of the rotary body 21. Each air collecting element 41 forms an air collecting chamber 43 with the outer circumferential surface of the rotary body 21. Each air collecting element 41 includes an air outlet conduit 44 connected to the air collecting chamber 43. Each air collecting element 41 includes an air leakage valve 46 (see FIG. 16), and includes a sealing member 461 which includes a body portion 4611. The body portion 4611 includes a projection 4612 at one end, and a connection portion 4613 at the other end. An elastic member 462 is sleeved around the body portion 4611, and a fixation portion 463 is locked to the connection portion 4613. Each air collecting element 41 includes a mounting portion 453 and a plurality of air leakage holes 454. The mounting portion 453 receives the sealing member 461. An O-ring 464 is disposed in an airtight manner between the projection 4612 and the air collecting element 41. After assembly, the elastic member 462 is compressed, with its top end pressing against the inner wall of the air collecting element 41 and the bottom end abutting the fixation portion 463, so as to urge the projection 4612 tightly against the O-ring 464, keeping the air leakage valve 46 closed. When the pressure in the air collecting chamber 43 exceeds a safe level, the pressure pushes open the projection 4612, opening the air leakage valve 46 to release high-pressure gas through the air leakage holes 454 and cut off the power to stop the operation of the gas compressor. When the rotary body 21 rotates such that all of the air holes 212 of the cylinder 211 correspond to the inner end surfaces 411 between two sides of the bottom of an air collecting element 41, the air holes 212 are blocked and not in communication with the air collecting elements 41 and air intake channels 42. When the rotary body 21 rotates, the air holes 212 communicate with an air intake channel 42, the piston shaft 31 moves along the track, and each piston 30 moves from the piston top dead center P1 to the piston bottom dead center P2 in an intake stroke corresponding to the air intake channels 42. All or part of the air holes 212 communicates with an air intake channel 42 to draw external gas into the cylinder 211. When the pistons move from the piston bottom dead center P2 to the piston top dead center P1 in a compression stroke corresponding to the air collecting chambers 43, all or part of the air holes 212 communicates with an air collecting chamber 43 to press the gas into the air collecting chamber 43, thereby completing a full compression cycle.

Figure 6:
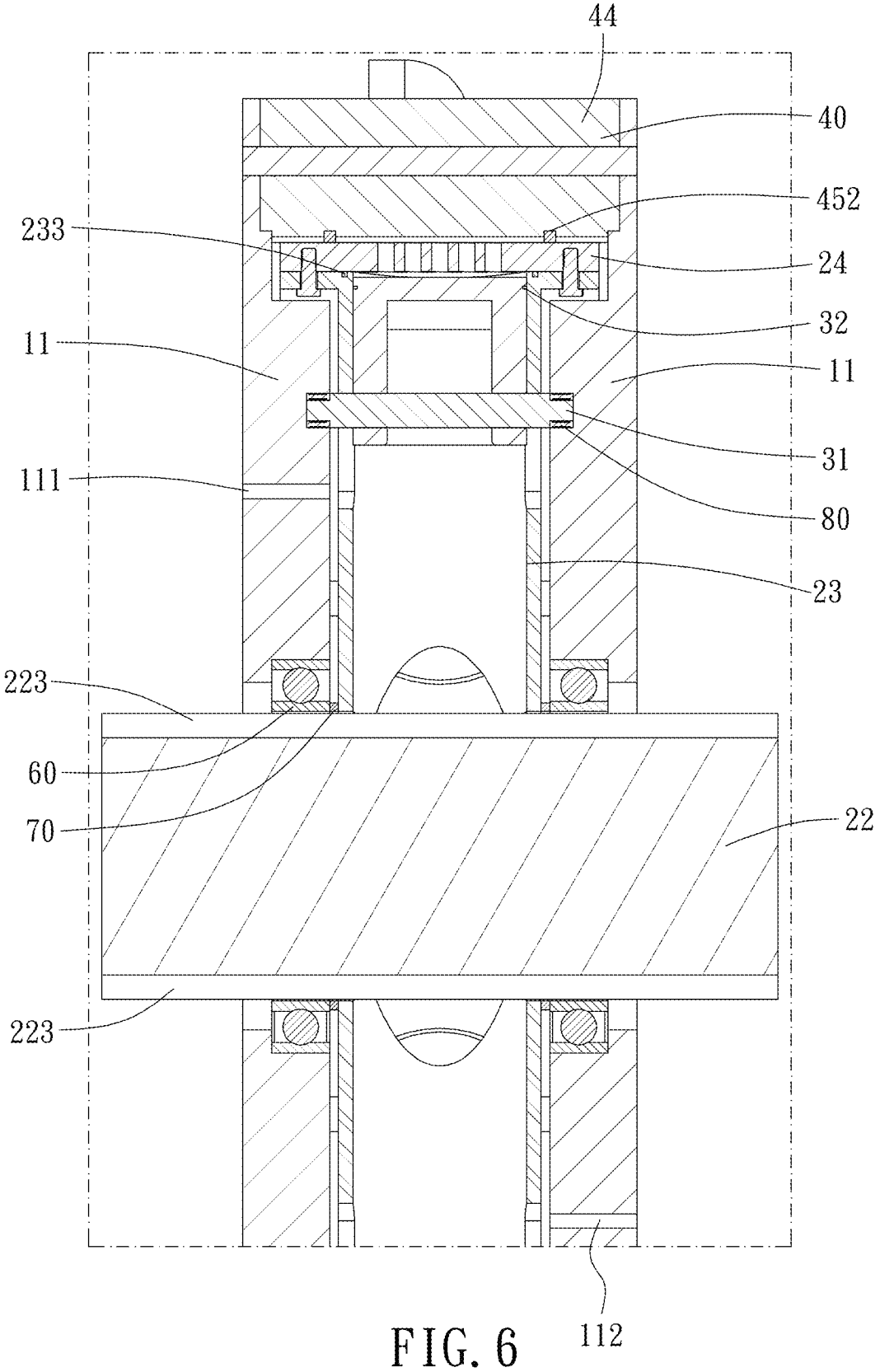
FIG. 6 is a partial cross-sectional view of the first exemplary embodiment.
Figure 8:
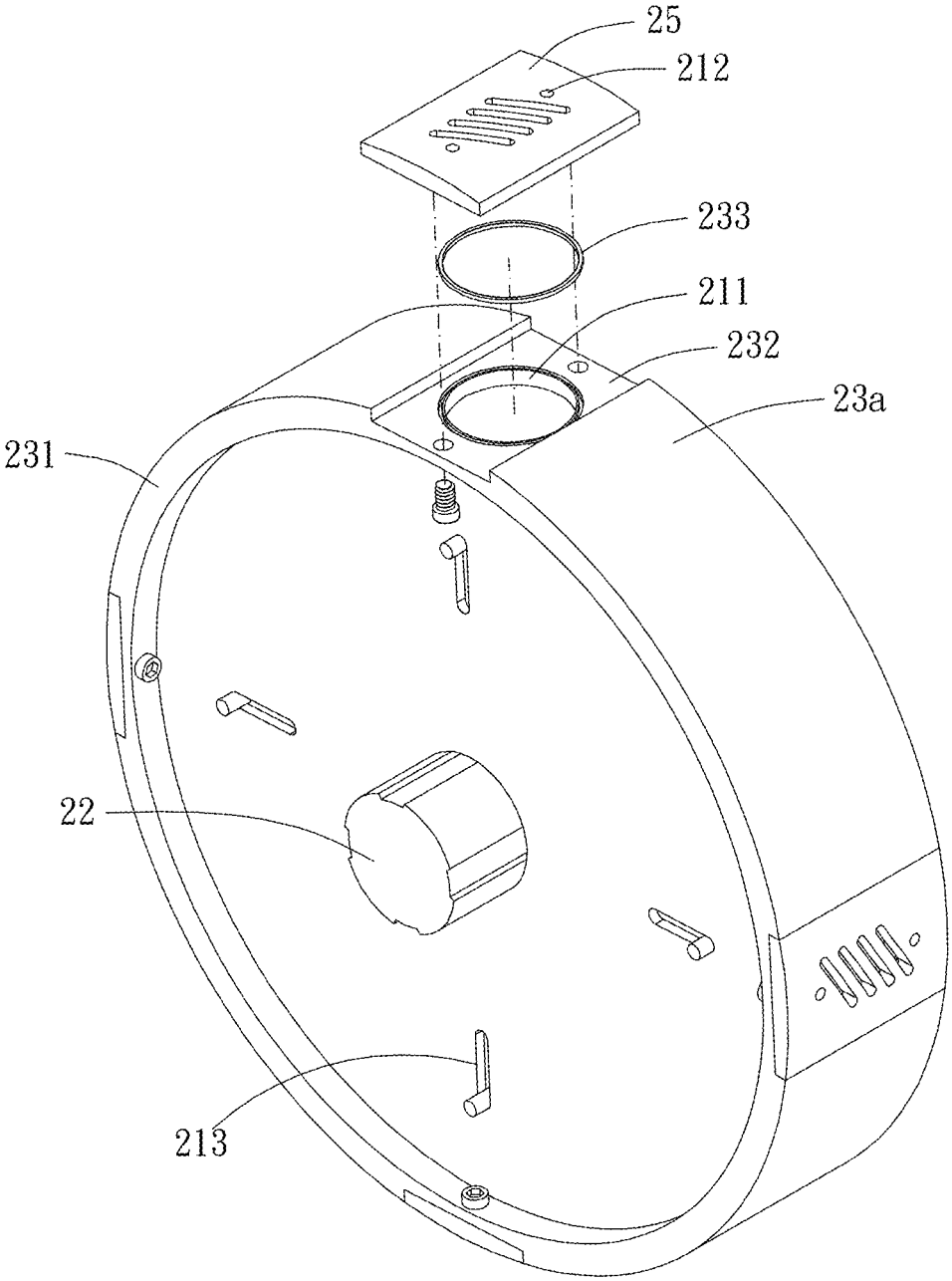
FIG. 8 is a partial perspective view of a second exemplary embodiment.

In this embodiment (see FIG. 3), the rotary body 21 includes a rotary core 23 and an outer ring 24. The rotary core 23 includes the plurality of cylinders 211. The outer ring 24 is sleeved on the rotary core 23 to cover the plurality of cylinders 211 and includes the plurality of air holes 212 corresponding to the cylinders 211. Preferably, relative to the rotation direction of the rotary body 21, the air holes 212 extend at an inclined angle (e.g., 45 degrees or other greater or lesser angles), which facilitates the smooth passage of the oil seal between the two. In a second embodiment (see FIG. 8), the rotary body 21 includes a rotary core 23*a* and a plurality of lids 25 corresponding to the cylinders 211. The rotary core 23*a* includes the plurality of cylinders 211. The plurality of lids 25 are connected to the rotary core 23*a* to cover the plurality of cylinders 211, and the air holes 212 are disposed through the lids 25. Specifically, the rotary core 23*a* includes axial flanges 231 on opposite sides, and a plurality of mounting slots 232 are disposed on the outer circumferential surface of the rotary core 23*a* and are in communication with the plurality of cylinders 211. A sealing O-ring 233 is disposed between one said lid 25 and one said cylinder 211. The lids 25 are received in the mounting slots 232 and fixed to the axial flanges 231. Additionally, the rotary multi-cylinder gas compressor shown in FIGS. 6 and 11 is applicable not only to the rotary core 23 but also to the rotary core 23*a* with lids 25.

Figure 3:
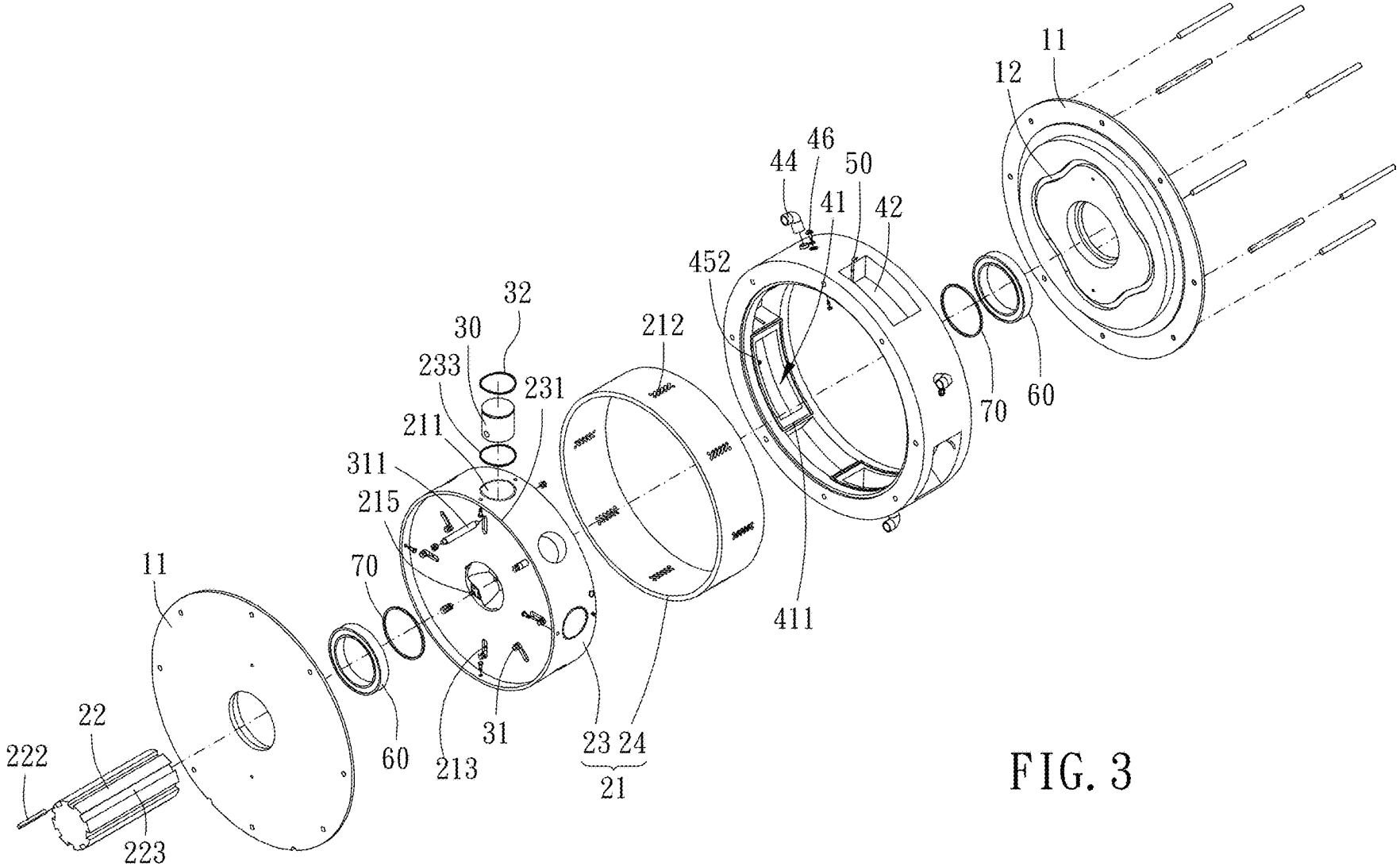
FIG. 3 is an exploded view of FIG. 2.
Figure 15:
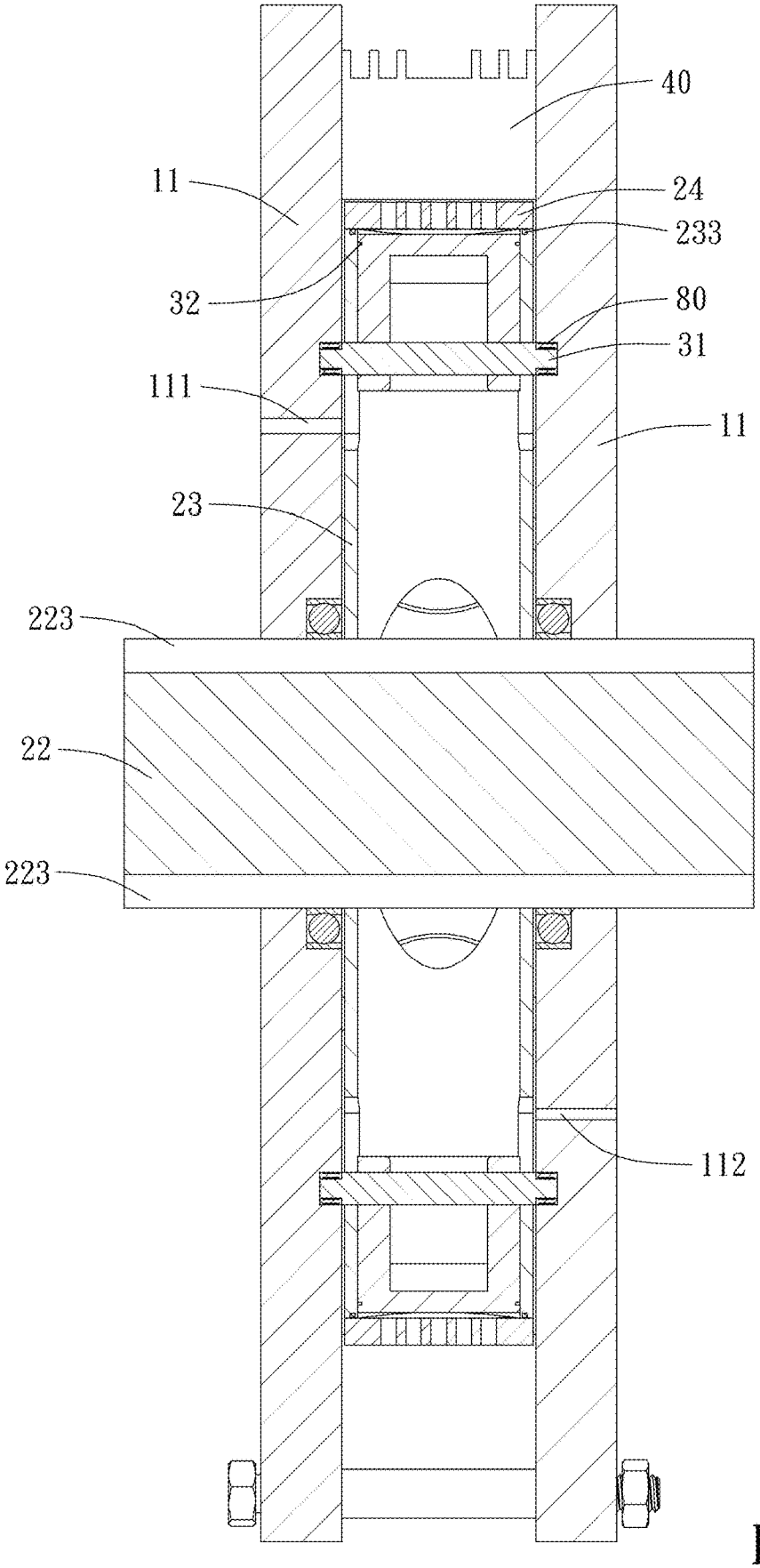
FIG. 15 is another cross-sectional view of FIG. 12.

In a possible embodiment, the rotary cores 23 and 23*a* and the mandrel 22 may be integrally formed (see FIGS. 12 and 15) or be separate components (see FIG. 3). When the rotor 20 is composed of separate components, a rotor recess 215 is provided at an axial bore between two cylinders, and an axially-projecting element 222 protrudes from the mandrel 22. The axially-projecting element 222 corresponds to the rotor recess 215. When the axially-projecting element 222 is inserted in the rotor recess 215, it synchronizes the rotation of the mandrel 22 and the rotary cores 23 and 23*a*. Because the circular rotor 20 and the air cover mechanism 40 both generally operate at room temperature, aligning their axes precisely minimizes the gap between them, which reduces gas leakage in the air collecting element 41 and ensures high operating efficiency even without an oil seal between the rotor 20 and the air cover mechanism 40.

Additionally, a plurality of axial ventilation grooves 223 corresponding to the cylinders 211 are disposed on the mandrel 22. During operation, when the piston 30 moves downward, air beneath the piston is discharged via the ventilation groove 223. When the piston 30 moves upward, external air enters the cylinder beneath the piston via the ventilation groove 223.

Figure 9:
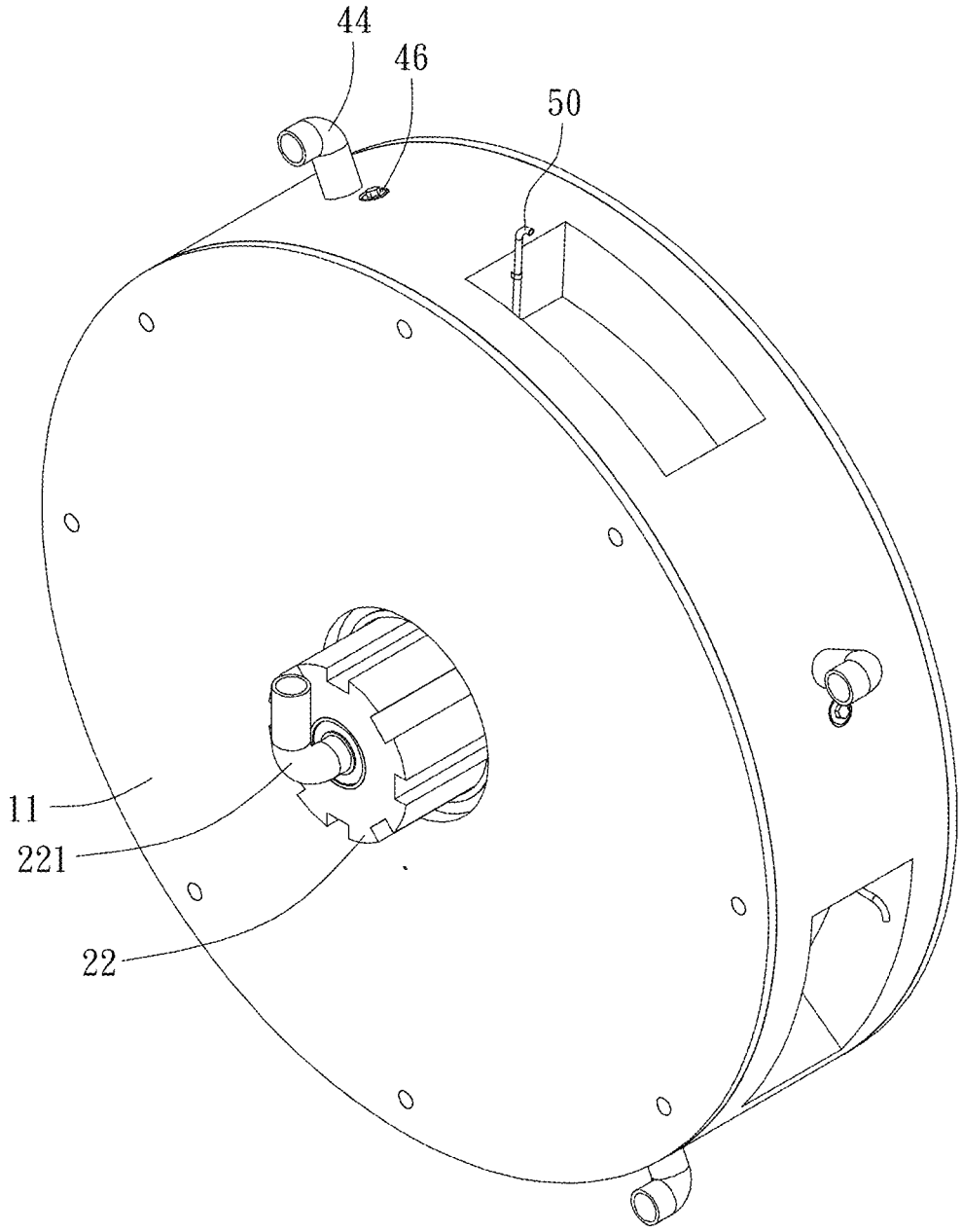
FIG. 9 is a partial perspective view of a third exemplary embodiment.
Figure 10:
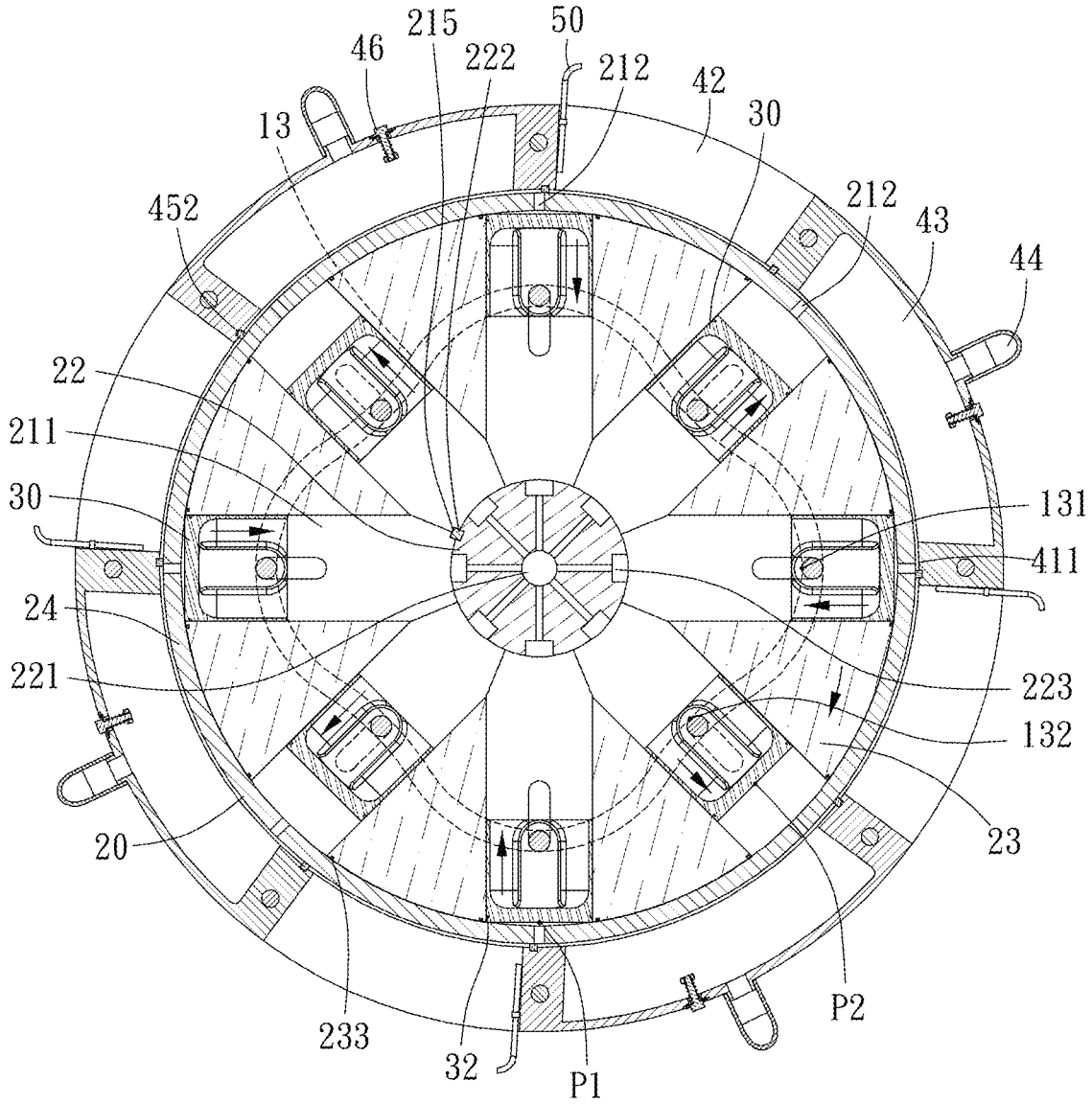
FIG. 10 is a cross-sectional view of FIG. 9.
Figure 11:
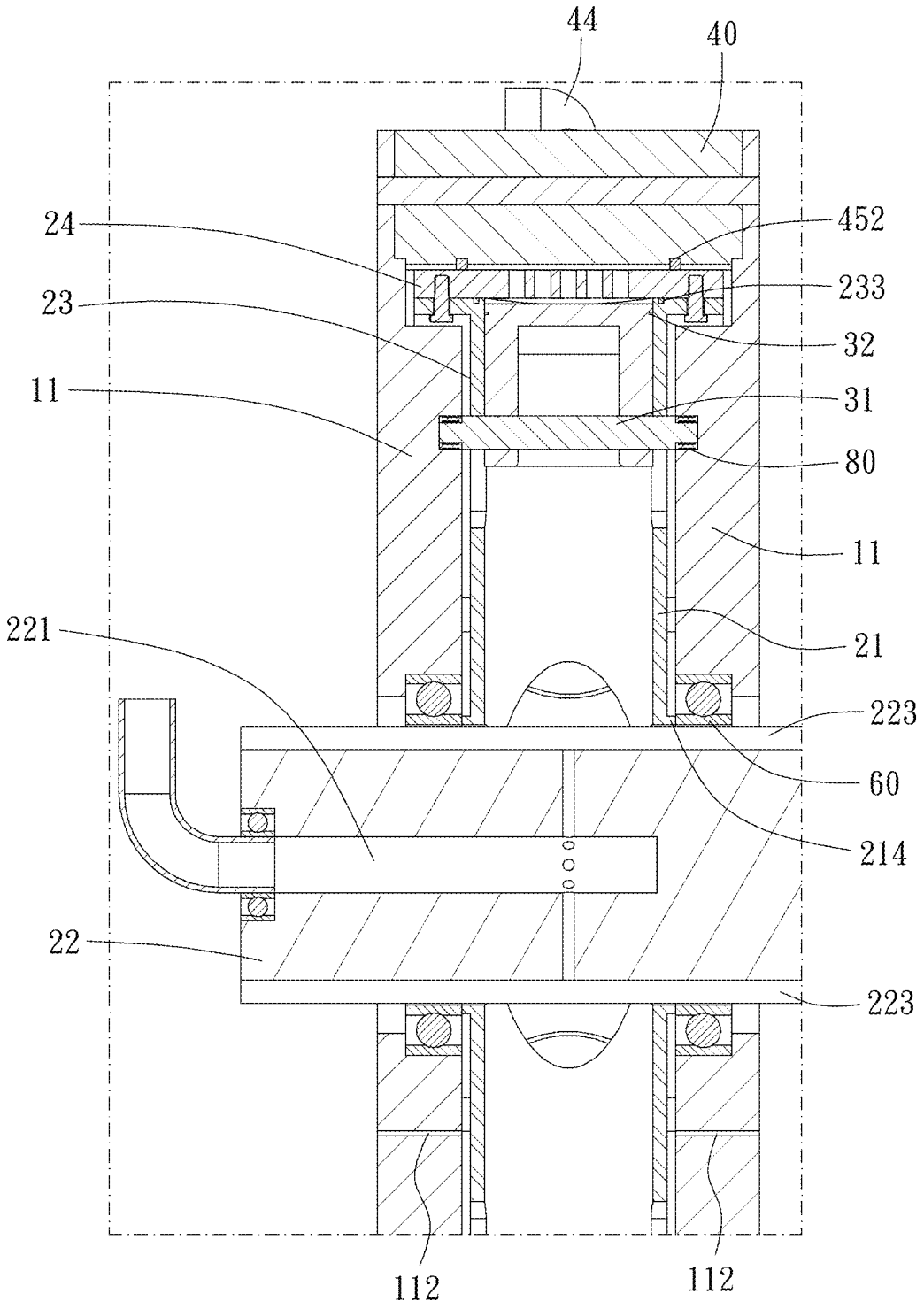
FIG. 11 is a partial cross-sectional view of the third exemplary embodiment.

In a third embodiment shown in FIGS. 9 to 11, oil can be injected through a conduit 221 of the mandrel 22 between components of the rotary multi-cylinder gas compressor. The lubricated oil may then be discharged from an oil outlet hole 112 of each stator 11, providing good lubrication.

Preferably, the rotary multi-cylinder gas compressor further includes a plurality of injection pipes 50 disposed on the stator mechanism 10, and each injection pipe 50 corresponds to and is positioned adjacent a side of the air collecting elements 41. This provides an appropriate amount of oil between the air cover mechanism 40 and the rotor 20, lubricating the cap seal at the bottom of the air cover mechanism 40, which enhances air tightness of the air collecting chamber 43. If some oil enters a cylinder 211 through the air hole 212 during injection, the centrifugal force will eject most of the oil out of the cylinder 211, and only a small portion will adhere to the cylinder wall to lubricate the oil seal 32 of the piston 30.

Preferably, at least one stator 11 is provided with an oil filling hole 111 for injecting oil into the gap, allowing the oil to enter the cylinder 211 through the two slots 213 to lubricate the piston 30. Under centrifugal force, some oil flows along the gap between the rotary body 21 and the stator 11 and into the space between the rotary body 21 and the air cover mechanism 40 via the inner end surfaces 411 on both sides of the bottom of the air collecting element 41, lubricating the oil seal between the air cover mechanism 40 and the rotary body 21. In this embodiment, one said stator 11 includes an oil filling hole 111 at the upper portion, and the other stator 11 includes an oil outlet hole 112 at the lower portion, allowing continuous lubrication.

Preferably, a bearing 60 is sleeved between the mandrel 22 and each of the stators 11. Using the principle that the inner ring of the bearing 60 is tightly fitted with the mandrel 22 and rotates synchronously, oil seals 70 are respectively disposed between the rotary body 21 and the stators 11 (see FIG. 6), or the rotary body 21 includes an axial protrusion 214 (see FIG. 11). The rotary body 21 and the stators 11 are held in fixed position due to mutual contact, sealing oil within the gap. Centrifugal force drives oil within the gap toward the contact point between the rotary body 21 and the air cover mechanism 40, thereby lubricating the oil seal between them.

Figure 7:
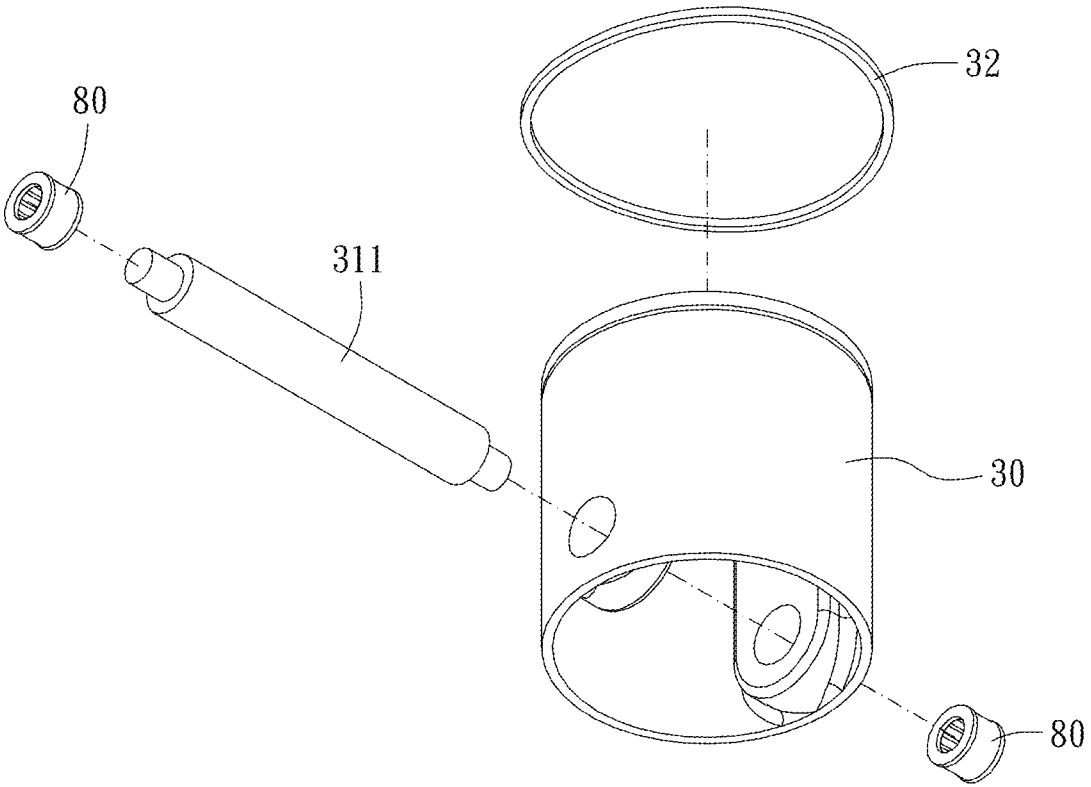
FIG. 7 is an exploded view of a piston in the first exemplary embodiment.

As shown in FIG. 7, the piston shaft 31 includes a rod member 311 and two bearings 80 sleeved on both ends of the rod member 311. The bearings 80 are inserted in both sides of the track 13. As the rotary body 21 rotates, the rod member 311 moves along the track 13 with the bearings 80 to drive the piston to move up and down in the cylinder 211.

Figure 4:
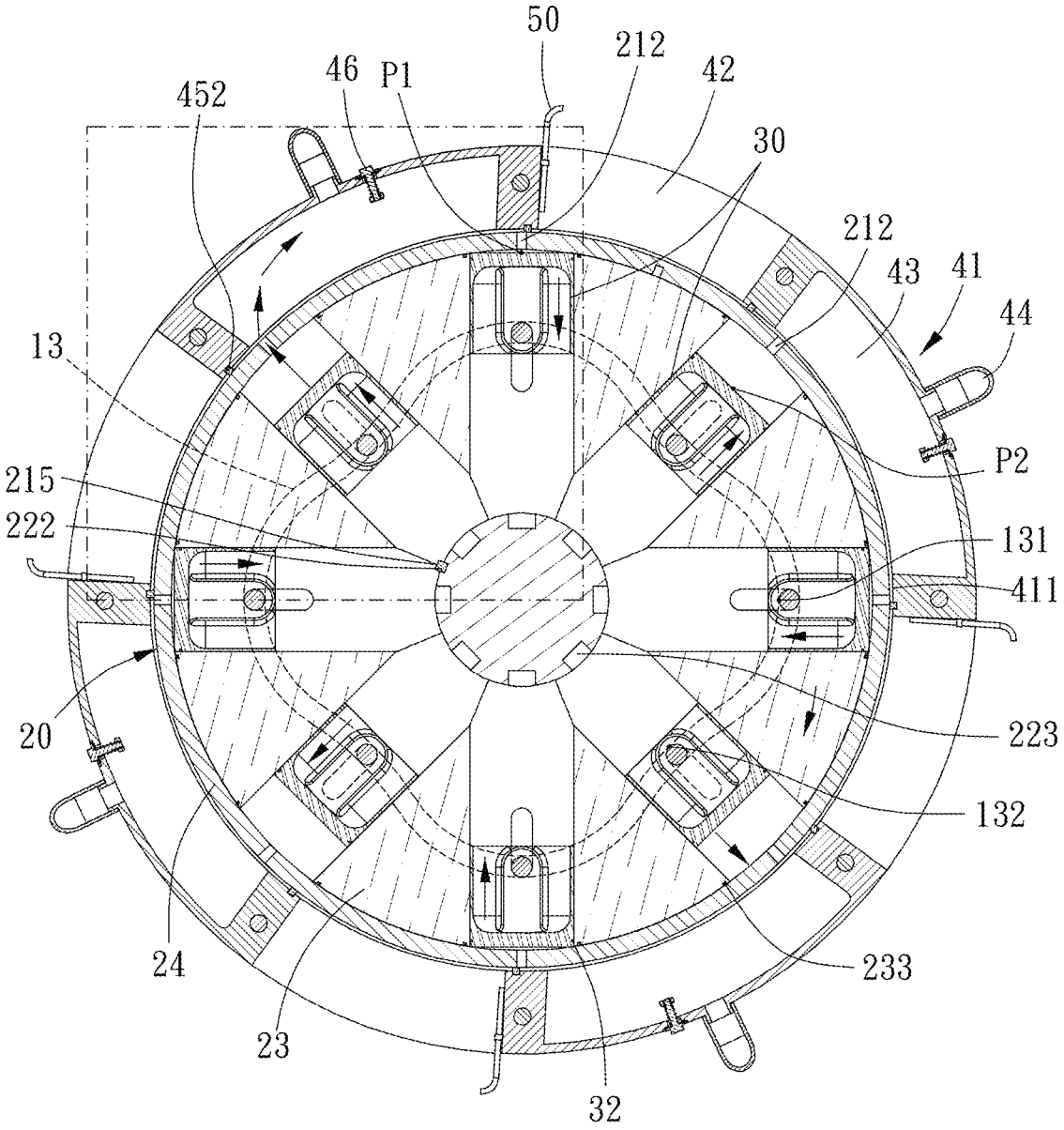
FIG. 4 is a cross-sectional view of FIG. 2.
Figure 5:
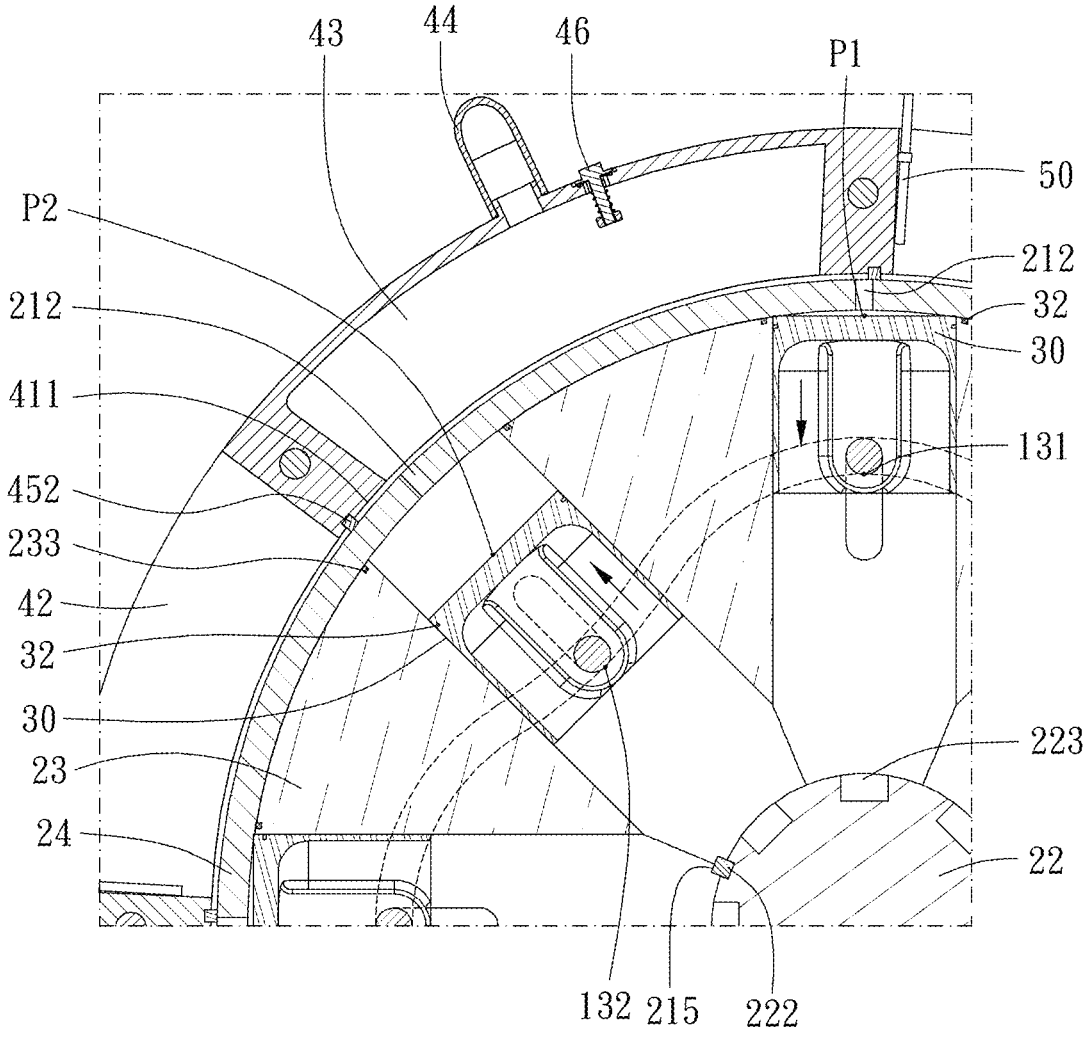
FIG. 5 is a partial enlarged view of FIG. 4.

As shown in FIGS. 4 and 5, in this embodiment, the air cover mechanism 40 is a ring member. The plurality of air intake channels 42 are disposed circumferentially spaced and through the ring member. The air outlet conduit 44 is connected to the air collecting element 41 of the air cover mechanism 40.

Because the rotary multi-cylinder gas compressor has virtually no issue of thermal expansion, and the rotary body 21 is a circular structure that can be precisely machined with high roundness, and because the mandrel 22 is a large-diameter shaft capable of supporting stable high-speed motion of the rotary body 21, an extremely minimized gap can be maintained between the air collecting element 41 and the rotor 20. For example, this gap may range between 50 and 100 microns. Moreover, if the bottom sides of the air collecting element 41 and the outer sides of the rotary body 21 are appropriately expanded, the escape velocity of the compressed gas inside the air collecting element 41 can be drastically reduced, thereby enhancing the working efficiency of the compressor. In addition, due to the strong structural support provided by the large-diameter shaft of the rotary multi-cylinder gas compressor, it is possible to serially connect a plurality of individual compressors on a single mandrel (as shown in FIG. 12), and interconnect their compressed gas outputs as needed, enabling the generation of a large volume of compressed gas within an extremely short time.

Figure 12:
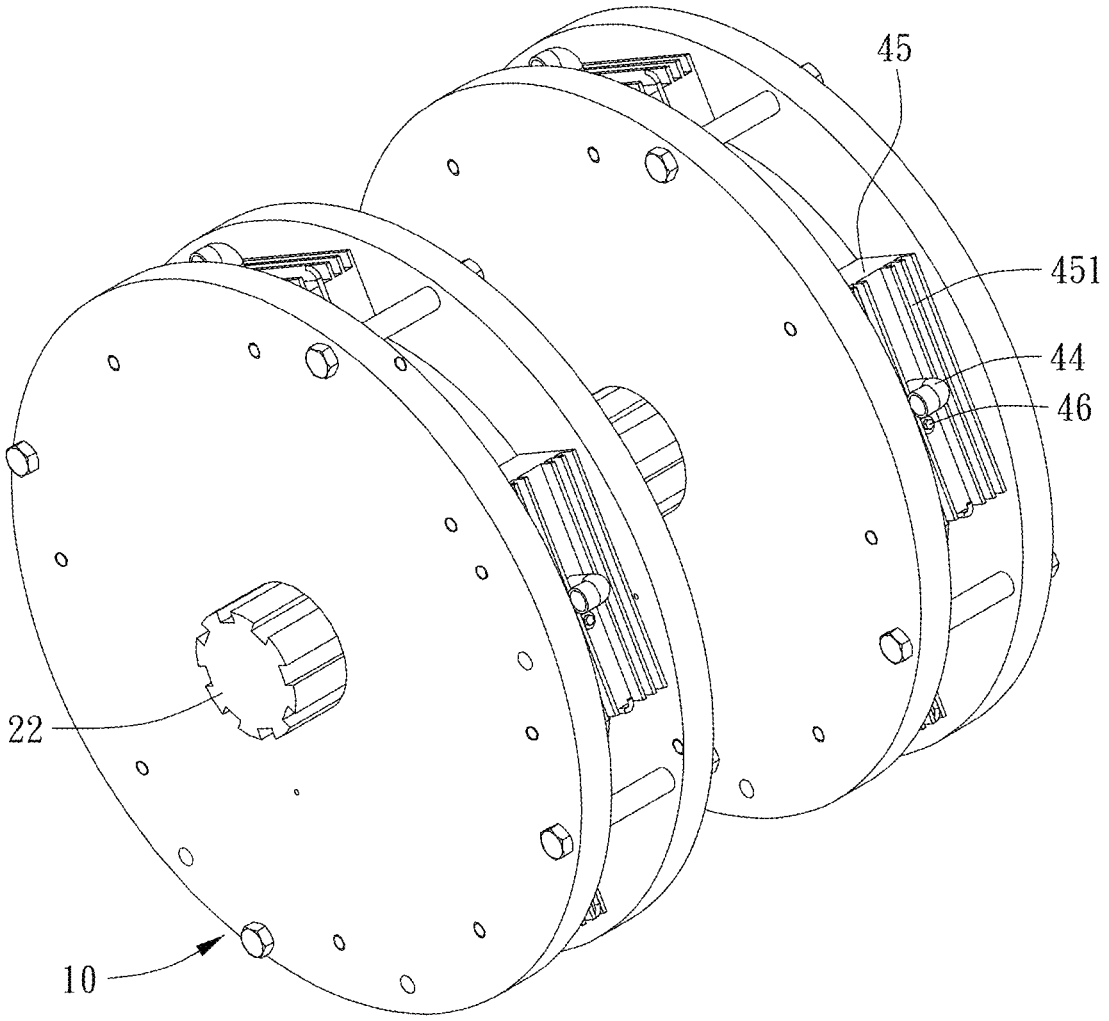
FIG. 12 is a partial perspective view of a fourth exemplary embodiment.
Figure 13:
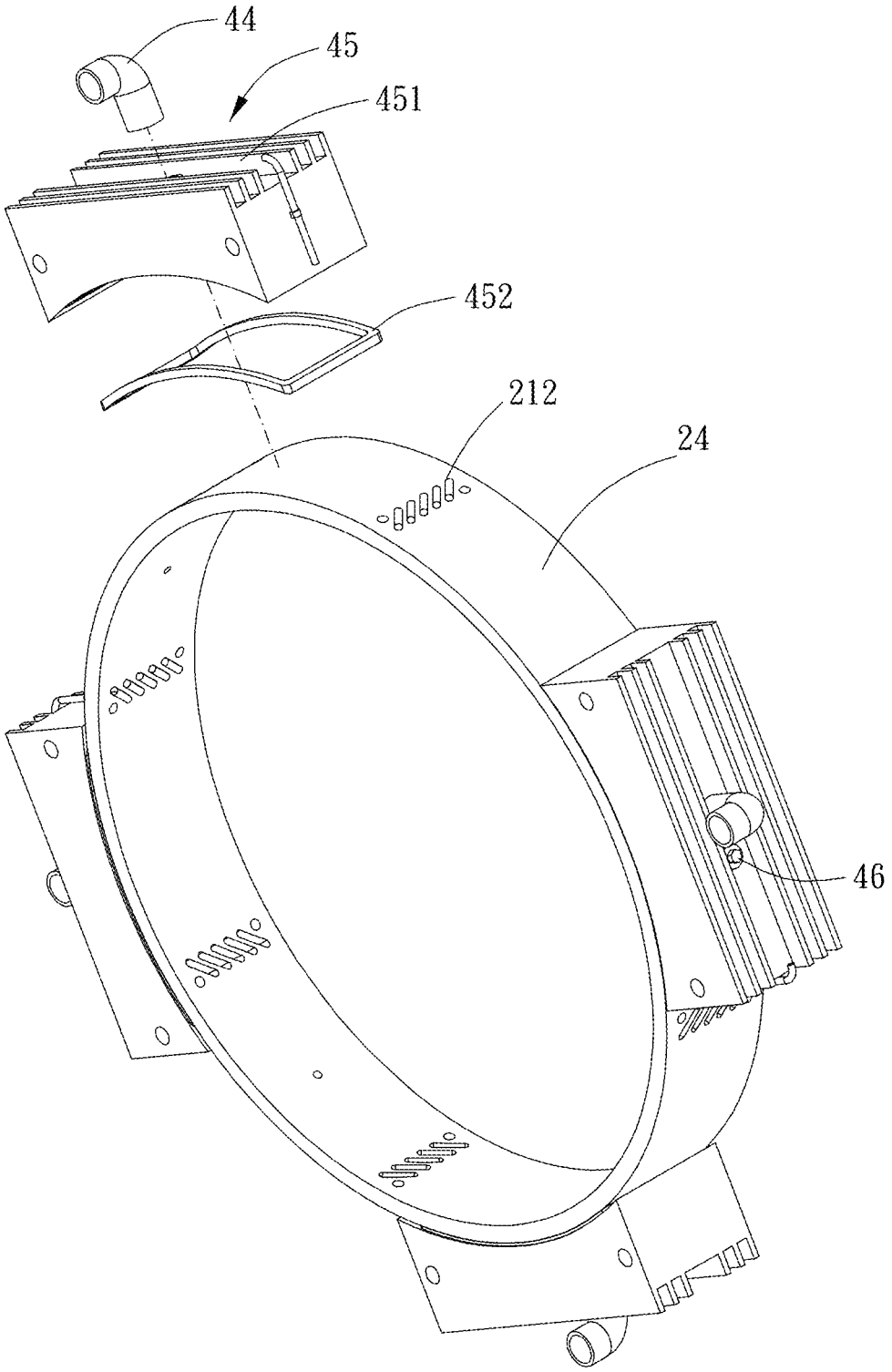
FIG. 13 is a partially exploded view of FIG. 12.
Figure 14:
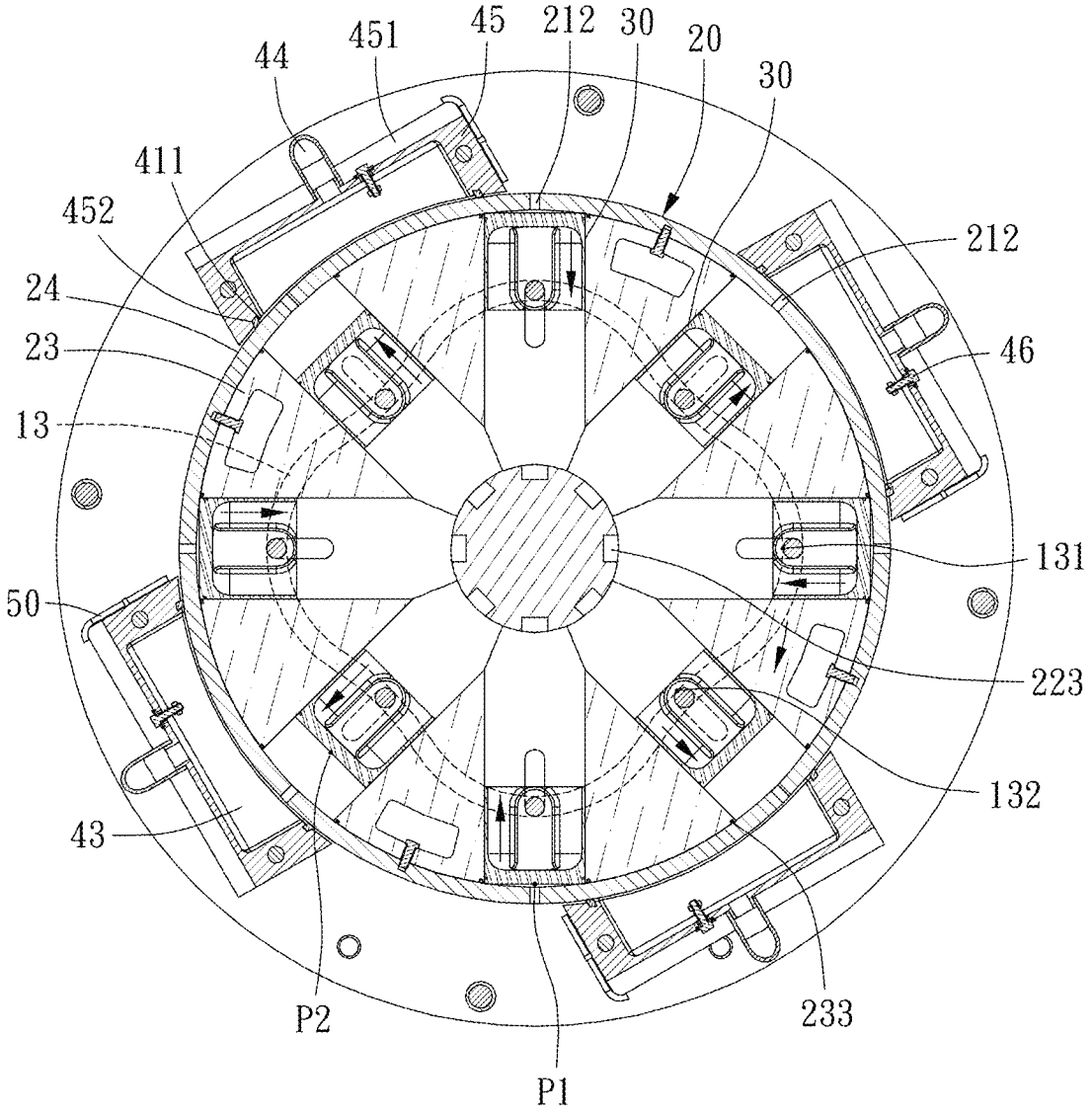
FIG. 14 is a cross-sectional view of FIG. 12.
Figure 17:
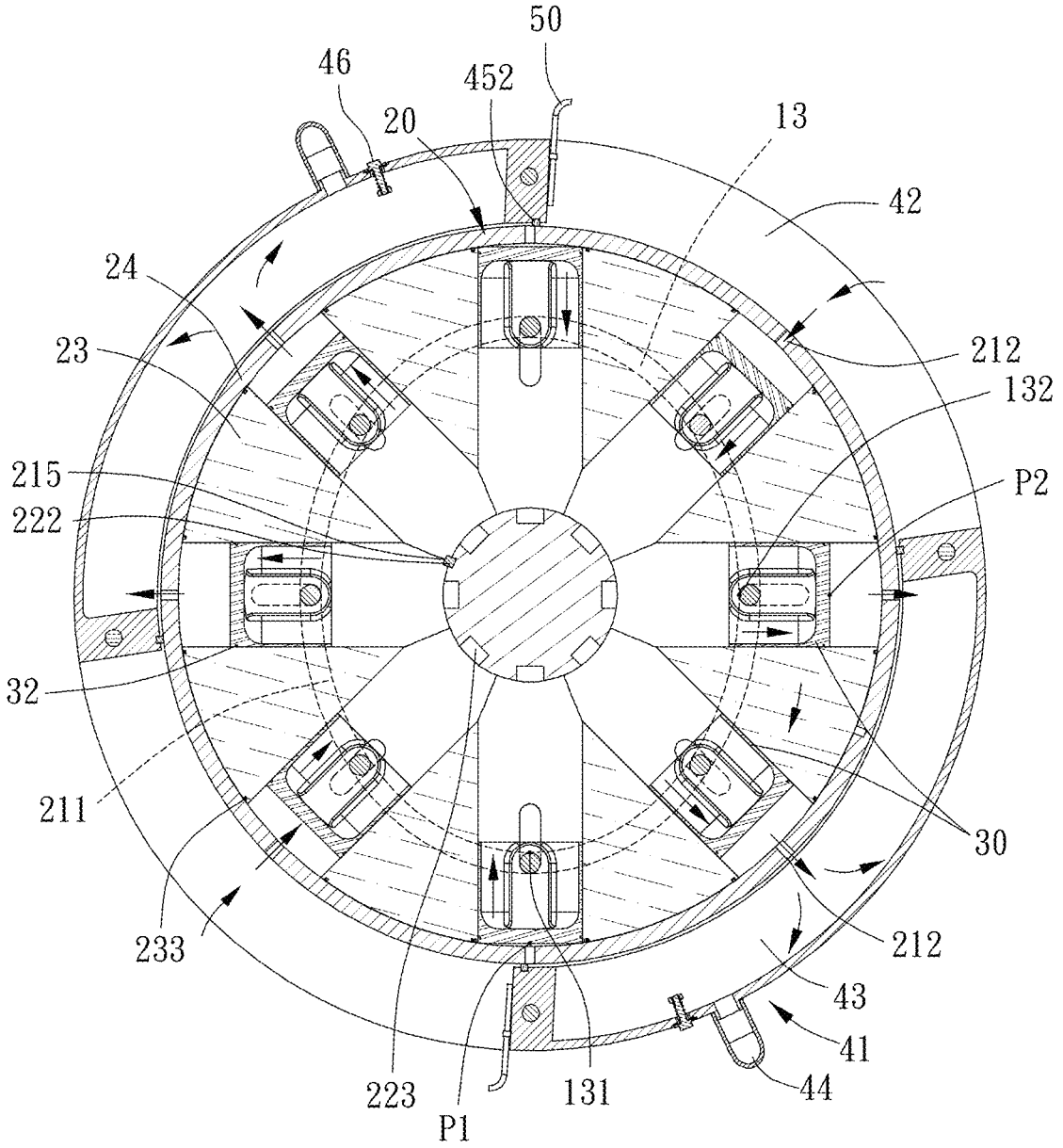
FIG. 17 is a partial perspective view of a fifth exemplary embodiment.

In a fourth embodiment shown in FIGS. 12, 13 and 14, the air cover mechanism 40 further includes a plurality of independent air collecting caps that form respective air collecting elements 41. Every neighboring two of the air collecting caps 45 form one of the plurality of air intake channels 42 therebetween. The air collecting caps 45 are secured to the stator mechanism and respectively form the plurality of air collecting elements 41. Preferably, an annular end surface of each air collecting cap 45 further includes a cap seal 452 which is in contact with the outer circumferential surface of the outer ring 24. A plurality of heat dissipation fins 451 are disposed on the outer surface of each air collecting cap 45. As the compressed gas generates heat, these heat dissipation fins 451 effectively reduce the temperature rise. In addition, the number of the plurality of air collecting caps 45 or the air collecting elements 41 is not limited to four, and it may be designed to be one, two, three or other numbers according to angle division. In addition, the number of the air collecting caps 45 or the air collecting elements 41 is not limited to 4, and it may be 1, 2, 3 or other numbers according to different angle divisions. For example, in FIG. 17 which is a structural schematic diagram of the rotary multi-cylinder gas compressor, the number of the air collecting elements 41 is 2.

The rotary multi-cylinder gas compressor has extremely high working efficiency. For example, in a rotary gas compressor with eight cylinders 211 and four air collecting elements 41, each cylinder 211 performs four compression strokes per rotation of the mandrel. That is, for each rotation of the mandrel, the eight cylinders perform a total of thirty-two compression strokes. If two identical compressors are serially connected on a single mandrel, a total of sixty-four compression strokes can be performed per rotation. In contrast, a traditional single-cylinder piston-type air compressor performs only one compression stroke per rotation of the crankshaft. Clearly, the working efficiency of the rotary multi-cylinder gas compressor far exceeds that of conventional air compressors. Furthermore, the high-speed compression capability of this gas compressor makes it possible to eliminate the need for bulky and heavy air storage tanks, significantly reducing manufacturing costs and improving convenience, speed, and efficiency during use.

The gas collected by the rotary multi-cylinder gas compressor can be used directly or stored in an air tank. It is also possible to use the rotary multi-cylinder gas compressor to replace the turbine of a jet engine. The main structure is a circular barrel with one closed end and a nozzle at the other. High-pressure gas is introduced via a duct with a check valve into the closed end of the circular barrel. Fuel is injected into the area where the high-pressure gas accumulates, serving as the combustion chamber. The expanding high-pressure gas is then ejected through the nozzle, generating strong thrust. This approach fundamentally redefines traditional jet engines. Because this new type of jet engine does not include a structurally complex turbine, the overall construction becomes simpler, more robust, and safer. For instance, it eliminates the possibility of bird strikes damaging the engine. Especially when the high-pressure gas collected by the rotary multi-cylinder gas compressor enters the jet engine tangentially along the circular direction of the combustion chamber, it causes the compressed airflow to rotate within the chamber. This rotation allows the fuel to be thoroughly mixed and completely combusted, improving upon traditional jet engines, where the linear high-speed airflow often prevents complete fuel combustion and results in fuel waste. Moreover, driven by a prime mover with strong torque (e.g., an internal combustion engine) and a heavy flywheel, the rotary multi-cylinder gas compressor can continuously feed high-pressure gas into the jet engine. This prevents backflow from fuel detonation, ensuring sustained and powerful thrust similar to a rocket. Additionally, this jet engine can be equipped with a rotatable bracket in the middle, allowing unrestricted nozzle direction. As a result, aircraft equipped with this engine can take off and land vertically without being constrained by runways.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A rotary multi-cylinder gas compressor including:

a stator mechanism including two stators, each of the two stators including a guide ring groove, the guide ring grooves of the two stators axially corresponding to each other to form a track;

a rotor including a rotary body and a mandrel axially connected to the rotary body, the mandrel being rotatably and axially inserted in the two stators, the rotary body and the mandrel being synchronously rotatably disposed between the two stators, the rotary body including a plurality of cylinders and a plurality of air holes corresponding to the plurality of cylinders, two slots being oppositely disposed through a wall of each of the plurality of cylinders, the plurality of air holes being open on an outer circumferential surface of the rotary body and respectively in communication with interiors of the plurality of cylinders;

a plurality of pistons respectively received in the plurality of cylinders, each of the plurality of pistons including a piston shaft axially extending through the two slots and movable along the track, each of the plurality of pistons defining a piston top dead center and a piston bottom dead center sequentially located relative to the track; and an air cover mechanism connected to the stator mechanism and including a plurality of air collecting elements and a plurality of air intake channels, the plurality of air collecting elements and the plurality of air intake channels being alternately arranged around the outer circumferential surface of the rotary body, each of the plurality of air collecting elements forming an air collecting chamber between itself and the outer circumferential surface of the rotary body, each of the plurality of air collecting elements including an air outlet conduit in communication with the air collecting chamber;

wherein when all of the plurality of air holes in communication with one of the plurality of cylinders correspond to inner end surfaces between two sides of a bottom of one of the plurality of air collecting elements, the plurality of air holes of the one of the plurality of cylinders are blocked and not in communication with the plurality of air collecting elements and the plurality of air intake channels;

wherein during an intake stroke in which the piston shaft of each of the plurality of pistons moves along the track from the piston top dead center to the piston bottom dead center, the plurality of air intake channels correspond to the plurality of pistons, such that all or part of the plurality of air holes are in communication with one of the air intake channels to draw external gas into one of the plurality of cylinders;

wherein during a compression stroke in which each of the plurality of pistons moves from the piston bottom dead center to the piston top dead center, all or part of the plurality of air holes are in communication with one of the plurality of air collecting chambers to press the gas into one of the plurality of air collecting chambers.

2. The rotary multi-cylinder gas compressor of claim 1, wherein the rotary body includes a rotary core and an outer ring, the rotary core includes the plurality of cylinders, and the outer ring is sleeved on the rotary core to cover the plurality of cylinders and includes the plurality of air holes corresponding to the plurality of cylinders.

3. The rotary multi-cylinder gas compressor of claim 1, wherein the rotary body includes a rotary core and a plurality of lids corresponding to the plurality of cylinders, the rotary core includes the plurality of cylinders, the plurality of lids are connected to the rotary core to cover the plurality of cylinders, and the plurality of air holes are disposed through the plurality of lids.

4. The rotary multi-cylinder gas compressor of claim 3, wherein the rotary core and the mandrel are integrally formed of one piece.

5. The rotary multi-cylinder gas compressor of claim 3, wherein opposite sides of the rotary core each include an axial flange, the outer circumferential surface of the rotary core includes a plurality of mounting slots, the plurality of mounting slots are respectively in communication with the plurality of cylinders, and the plurality of lids are received in the plurality of mounting slots and secured to the axial flanges, respectively.

6. The rotary multi-cylinder gas compressor of claim 1, wherein the piston shaft includes a rod member and two bearings sleeved on ends of the rod member.

7. The rotary multi-cylinder gas compressor of claim 1, wherein the air cover mechanism is a ring member, the plurality of air collecting elements and the plurality of air intake channels are circumferentially spaced and disposed through the ring member, and the air outlet conduit is connected to the ring member.

8. The rotary multi-cylinder gas compressor of claim 1, wherein the air cover mechanism further includes a plurality of air collecting caps, and the plurality of air collecting caps are secured to the stator mechanism to form the plurality of air collecting elements, respectively.

9. The rotary multi-cylinder gas compressor of claim 8, wherein an outer surface of each of the plurality of air collecting caps includes a plurality of heat dissipation fins.

10. The rotary multi-cylinder gas compressor of claim 1, wherein the mandrel is connected to another rotary multi-cylinder gas compressor.

* * * * *